United States Patent [19]

Barabino

[11] Patent Number: 5,046,620

[45] Date of Patent: Sep. 10, 1991

[54] PORTEMONNAIE ASSEMBLY

[76] Inventor: William A. Barabino, 5 Westchester Dr., North Reading, Mass. 01864

[21] Appl. No.: 583,568

[22] Filed: Sep. 17, 1990

[51] Int. Cl.[5] ..... A45G 1/02; A45G 3/06

[52] U.S. Cl. ..... 206/581; 206/225; 206/235; 206/38; 150/101; 150/112; 150/117

[58] Field of Search ..... 150/101, 112, 116, 117; 206/225, 581, 235, 38; 383/84, 86, 38, 39

[56] References Cited

U.S. PATENT DOCUMENTS

| | | | |
|---|---|---|---|
| 1,564,966 | 12/1925 | Kulick | 150/101 |
| 1,980,133 | 11/1934 | Filipowicz | 150/101 |
| 2,437,120 | 3/1948 | Parker | 206/235 X |
| 2,521,377 | 9/1950 | Kirsch et al. | 150/101 |
| 2,687,835 | 8/1954 | Plonczak | 206/38 R |
| 2,802,501 | 8/1957 | Stember | 150/101 |
| 4,301,916 | 11/1981 | Handelman | 206/38 |

*Primary Examiner*—William I. Price
*Attorney, Agent, or Firm*—Richard C. Litman

[57] ABSTRACT

A portemonnaie assembly includes a substantially flat housing defined by an integral outer member forming front and rear panels with the rear panel extending to provide a closure flap foldable over the top access to a storage area therein. A unitary partition and privacy member anchored within the storage area permits the placement, storage and removal of personal hygiene articles of minimum dimensions, within the storage area and to one side of the partition section with the privacy section being foldable thereover to provide non-viewable sequestering of these articles. Preferably, these articles include a miniature tampon and feminine napkin together with a pair of disposable panties such that the user will be prepared for unexpected menses. Other, more frequently accessed articles such as cosmetics, are placed adjacent the outer surface of the privacy section and readily accessible without disturbing or exposing the personal hygiene articles. The supple composition of the partition and privacy member and its textured or brushed surface insures its conformance to the contained personal hygiene articles therebeneath while its positive retention in the privacy mode is maintained as its peripheral edges engage a similarly textured lining provided upon the inner surface of the housing. Still another storage area is defined between the partition section and front panel of the housing and serves to receive flat articles such as currency, licenses and credit cards.

13 Claims, 2 Drawing Sheets

PORTEMONNAIE ASSEMBLY

FIELD OF THE INVENTION

This invention relates generally, to a portemonnaie assembly and more particularly, to a personal hygiene effects carrier especially useful for women and adapted to be disposed within a larger handbag or utilized separately as a clutch purse or the like. The present assembly is of especial merit in providing discreet and immediate access to protective articles as a required to accommodate the onset of unexpected menses while at the same time allowing the carriage of cosmetic and other daily use articles.

BACKGROUND OF THE INVENTION

Portemonnaie devices per se have been available for generations and are produced in every conceivable shape and size. The dictates of fashion and ever-changing life styles clearly establish the needs of women with respect to accessory devices. Many women will not consider themselves properly dressed if not accompanied by an appropriate handbag, purse or the like. In years past, relatively large handbags were the vogue while more recently, smaller bags or purses have become quite popular. Hand held or clutch purses have always been considered appropriate for evening use and now, such devices are finding favor for all-around use.

Throughout the ages women have been faced with the dilemma of suitably accommodating items of personal hygiene as they travel about during the course of the day or evening. Of particular desire, is the provision of means to considerately store and have readily available such articles as may be required during the onset of a woman's menses. Many instances are known wherein women have dropped their purse, spilling its contents for all to see, much to the embarrassment of the victim. Without even dropping a purse, it is common for one to remove an innocuous item, such as a handkerchief, only to accidentally also withdraw a tampon, diaphragm or other personal hygiene item. Such incidents occur whether a person is using a typical large handbag with or without separate compartments or, a small clutch purse.

The need exists for a small, unobtrusive portemonnaie device of the clutch or hand held variety and which enables the user to discretely accommodate items of personal hygiene as well as other items, such as cosmetics, credit cards, currency and the like and wherein access to the latter class of items may be achieved without exposing or inadvertently withdrawing the personal hygiene items.

DESCRIPTION OF THE RELATED ART

The concept of providing a small purse device including a main storage area in combination with a secondary storage area is generally well known as shown in U.S. Pat. No. 2,745,456 issued to Rubin and which teaches a main housing having a flap that also serves to support a smaller housing having its own closure means. An example of a carrying case specifically intended to accommodate personal hygiene articles will be found in U.S. Pat. No. 4,286,639 issued to Murphy and which discloses a wallet member having a compartment serving to discretely house a feminine napkin or tampon. A further example of storage means especially adapted to accommodate personal hygiene articles will be seen in U.S. Pat. No. 4,848,588 issued to Rasmussen and which illustrates a rigid container having movable dividing means and provided with a rigid sliding cover. None of the known prior art is seen to suggest the novel combination as taught by the instant assembly.

SUMMARY OF THE INVENTION

By the present invention, an improved portemonnaie assembly is provided and which allows users to possess, transport and avail themselves of personal hygiene items in a most discreet manner without experiencing the embarrassment of accidentally exposing such items during the use of the same assembly to retrieve cosmetic and other contained articles. The assembly comprises a case or housing constructed of a relatively soft composition such as eel skin and which, in view of its softness does not require the provision of pleats to provide an expandable interior capable of automatically accommodating a plurality of adjacently disposed layers or planes of irregularly configured articles. The case is formed from an integral member defining front and rear panels with an intermediate containment area therebetween and the rear panel extending to form a closure flap adapted to overlie the top access to the storage area.

Two separate pockets or storage areas are formed within the containment area by means of an insert element comprising a unitary partition and privacy member. To one side of the partition section, the user places those articles which are considered to deserve all modesty in their storage and use, following which the privacy section is overfolded these articles and tucked into the same pocket to fully contain and mask them. The remaining space within this latter pocket is then utilized to receive and store other articles of more frequent or regular use such as cosmetics. Preferably, the partition section is affixed to the case only along its lateral and/or bottom edges such that still another pocket or storage area is formed intermediate the partition section and front panel of the case. In this manner, planar, thin articles such as currency bills, keys, credit cards, licenses, etc. may be accommodated in a separate area completely unaffected by access to either of the other areas.

The inner face of the case is preferably lined with a soft composition such as brushed leather. This texture cooperates with a similar texture as provided by the partition and privacy member which is substantially more supple than the outer layer of the case. In this manner, when the privacy section is overfolded and tucked into the principle storage area, it is retained in this security position by the anti-friction engagement between the members, until the user intentionally withdraws the privacy section to expose the heretofore concealed contents.

As stated before, the case is intentionally configured of a relatively small size, such as that of a clutch purse and its unobtrusiveness readily lends itself to use around the clock and under all social and hygenic situations and within all environments. In support of this, personal hygiene articles adapted for such a small purse are proposed for use therewith and include but are not limited to, miniature travel size tampons and feminine napkins, both of which are available as individual prewrapped items defining a maximum dimension of no greater than 8 cm (3 inches) in length or height and a thickness no greater than 13 mm (0.5 inches). Also proposed to be included in the assembly of the present invention is a pair of disposable panties. Such garments are available in a disposable material and may be folded or rolled to a configuration falling within the above mentioned dimensions. The inclusion of such an article will be found to be most beneficial to accommodate the onset of unexpected menses, in view of the soiling of the wearer's panties which occurs when the menses onset is truly unexpected and no anticipatory wearing of a tampon or feminine napkin has been practiced. It is anticipated that other articles of personal feminine hygiene may be included such as a pre-moistened wipe or towelette, condoms, diaphragm, IUD etc., all of which are of an overall dimension and thickness conveniently carried in a discreet manner within the instant assembly.

Accordingly, one of the objects of the present invention is to provide an improved portemonnaie assembly including an integral housing of soft material forming a storage area containing a unitary partition and privacy member allowing of the containment of personal hygiene articles adapted to be enshrouded by the privacy member while permitting the unencumbered access to other articles normally separated by the privacy member.

Another object of the present invention is to provide an improved portemonnaie assembly including a housing lined with soft material and cooperating with a unitary partition and privacy member of supple textured material adapted to be overfolded personal hygiene articles within the interior of the housing and remaining in its privacy mode even as other articles disposed outside the privacy member are accessed.

A further object of the present invention is to provide an improved portemonnaie assembly including a storage area therein for retaining a miniature tampon and feminine napkin together with a pair of disposable panties and with a partition and privacy member anchored within the storage area and displaceable to fully enshroud these articles while allowing of the insertion, containment and removal of other articles without violating the secluded containment of the first mentioned articles.

Still another object of the present invention is to provide an improved portemonnaie assembly including a housing having a storage area divided by a partition and privacy member providing a main containment area to one side for receiving personal hygiene articles which are enshrouded by infolding of the privacy member while other articles may be stored outside the privacy member and still other, very thin articles are insertable between the partition and the front panel of the housing.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
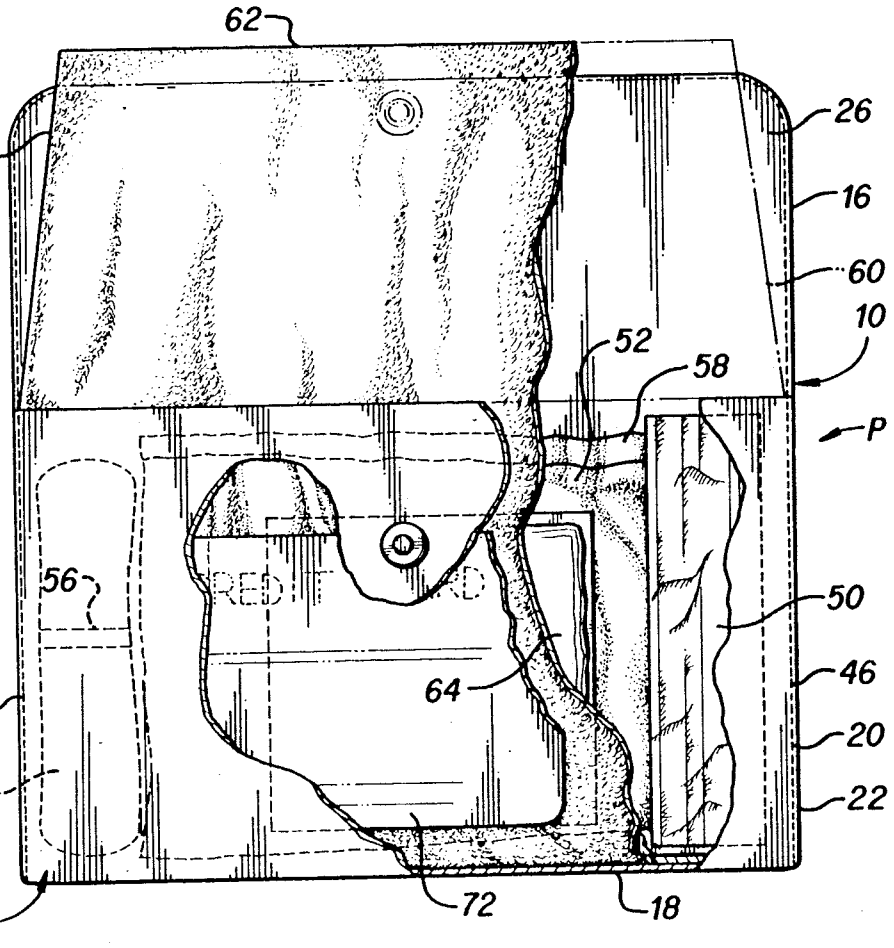
FIG. 1 is a front elevation of the portemonnaie assembly with portions broken away to illustrate three classes of articles as contained therein.

Referring now to the drawings, particularly FIG. 1, the present invention will be understood to comprise a portemonnaie assembly, generally designated P and which includes a housing or case 10 preferably formed as an integral piece having a front panel 12, rear panel 14 and distal flap 16. These two panels are folded along a bottom edge 18 and stitched or otherwise secured, as at 20, along their juxtaposed side edges 22 to form an interior storage area 24 between the two panels 12, 14. This housing 10 may be constructed of any suitable composition which is soft to the touch but exhibits sufficient stiffness to retain the rectangular configuration as shown, even when resting upon its bottom edge 18, with or without articles disposed therewithin. Obviously cloth would not fill this requirement but any of several well known natural or synthetic substances may be utilized such as eel skin, other skins or leathers, plastics, etc. Depending upon the material selected, that is, the finish of its inner surface and/or its stiffness, an inner lining 26 may be provided and which fully overlies the inner surfaces of the housing 10.

The integral flap 16 is adapted to overfold, along the hinge area 28, to a closed position overlying a substantial portion of the outer face 30 of the front panel 12 and in which position the top access area 32 of the storage area 24 is in effect closed. Suitable releasable fastening means, such as the snap fastener members 34, 36 serve to retain the flap 16 in the closed position.

Affixed within the storage area 24 is a partition and privacy member 38 comprising a unitary insert element having a partition section 40 and adjacent privacy section or flap 42. The lower edge 44 of the partition section 40 is juxtaposed the bottom fold or edge 18 of the housing while the lateral edges 46, 46 thereof are respectively juxtaposed the housing side edges 22, 22. The partition section 40 is secured in place, preferably by means of the same stitching 20 such that the storage area 24 is divided into a main storage compartment **24*a* and secondary storage compartment 24*b*. During the formation of the assembly P, the fullness of the material forming the housing 10 and insert member 38 is arranged such that the secondary compartment 24*b* defines an area of limited thickness while the main compartment 24*a*** may be readily opened to provide a front to rear dimension of approximately 2.5 cm (1 inch) throughout the majority of its length, the latter of which is approximately 14.5 cm ($5\frac{3}{4}$ inches). At this point the height of the assembly may be mentioned since this dimension involves a degree of criticality in view of the combination of specific articles intended to be accommodated within the assembly. This height should be no less than 7.5 cm (3 inches) for reasons which will become obvious hereinafter.

It is through use of the partition and privacy member 38 that a plurality of personal hygiene articles, particularly those necessary to accommodate unexpected menses, are conveniently carried within the housing 10 in a most discrete manner. This is achieved while allowing of the carriage and access of other, more commonly accessed articles such as cosmetics, credit cards and currency and without any concern of becoming embarrassed by the inadvertent exposure or spillage of the personal hygiene articles. These latter articles are intended to be disposed within the primary or main storage compartment 24*a*, immediately adjacent the inner face 48 of the insert element 38, as shown in FIGS. 2 and 3 and retained therein upon infolding of the privacy section 42 to the position as shown in FIG. 2 wherein it will be seen that a privacy sub-compartment or storage area 24*c* is formed within the confines of the infolded privacy section 42.

Specific articles are intended to be carried within the privacy area 24*c* as illustrated in FIGS. 1–3 and 5 and include a miniature tampon 50, tri-folded feminine napkin 52 and a disposable pantie 54 as a minimum. Each of these articles is preferably pre-packaged. Miniature tampons are available wherein the absorbent tampon and its applicator are sealed in a wrapper while tri-folded feminine napkins of minimum bulk are likewise available in individual packages, all within the size constraints mentioned hereinbefore. The pantie 54 is of the disposable type, that is, it is intended to be worn but once and then disposed of. Generally, female panties are constructed of woven polyester, nylon, rayon or cotton or, various blends thereof. These conventional materials will be found to be inappropriate for the pantie 54 forming a part of the present menses kit. With the exception of all-cotton panties, the above materials all have a degree of slip and resiliency that make them unsuitable for the automatic, high-speed tight folding and rolling necessary in producing the instant pantie 54. The expense and bulk of a cotton pantie rules out its consideration for use with the present kit. Accordingly, it will be understood that the pantie 54, exclusive of any elastic and cotton insert, will be constructed of a suitable non-woven polymeric material such as bonded nylon or polypropylene and which may be readily folded upon itself and tightly rolled to form the cylindrical configuration as in FIG. 1. A suitable removable band 56 serves to secure the rolled pantie 54 in the compact, ready-to-use condition.

Figure 2:
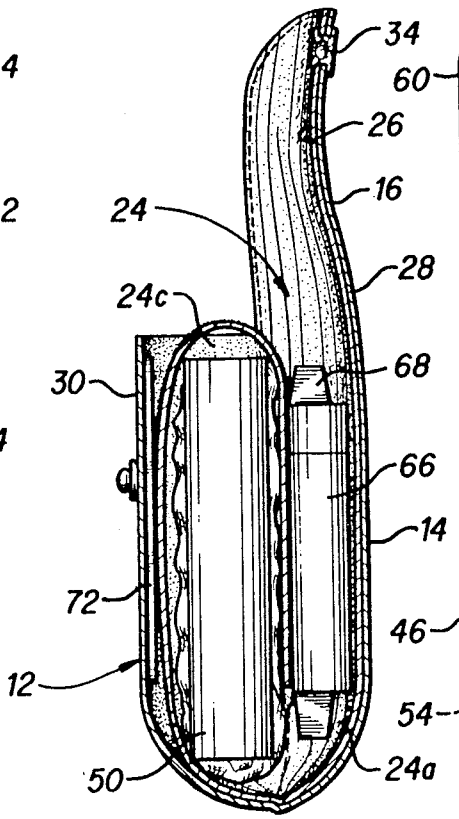
FIG. 2 is a vertical cross-sectional view with the privacy section positioned to enshroud the personal hygiene articles therebeneath.
Figure 3:
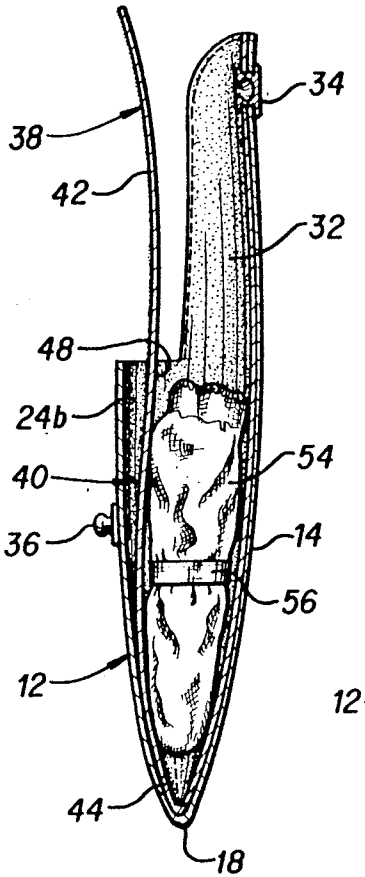
FIG. 3 is a vertical cross-sectional view with the privacy section displaced to allow access to personal hygiene articles.

Deliberate access to any of the personal hygiene articles is achieved only by the intentional removal of the privacy section 38 from its secured position of FIG. 2 to the opened condition as depicted in FIG. 3 whereafter, the user may easily remove the desired article(s). If, upon the onset of unexpected menses, the user's conventional panties have become soiled, as is often the case, these panties may be conveniently accommodated by means of a folded plastic bag 58, likewise stored within the privacy area 24*c*. Another article often found to be desirable is a premoistened wipe or towelette 64 may also be stored within the privacy area 24*c*. These two latter articles comprise planar members which are quite thin and thus add very little to the minimal bulk as presented by the laterally adjacent catamenial articles 50,52 and the pantie 54. As these three latter articles each defines a thickness of approximately 1.25 cm (0.5 inches), the addition of the very thin towelette 64 and bag 58 adds negligible bulk to the assembly P.

The insertion and removal of the privacy section 42 between the positions of FIGS. 2 and 3 is facilitated by the tapered formation of the section side edges 60—60 which, from FIG. 1 will be seen to taper inwardly toward the free edge 62. This construction discourages jamming or bunching of the privacy section 42 as it is tucked into the storage area 24 and additionally assists in maintaining the minimum bulk of the assembly P. The supple nature of the insert element 38 further assists in maintaining the minimal bulk feature of the invention as it freely conforms to the configuration of the contained articles and also makes available the maximum extent of the remaining area 24*a* in the main storage compartment. Additionally, the brushed or textured surface of at least the privacy section 42 produces a frictional engagement, both with the contained articles as well as the housing lining 16, that assists in retaining the privacy section in place.

Figure 5:
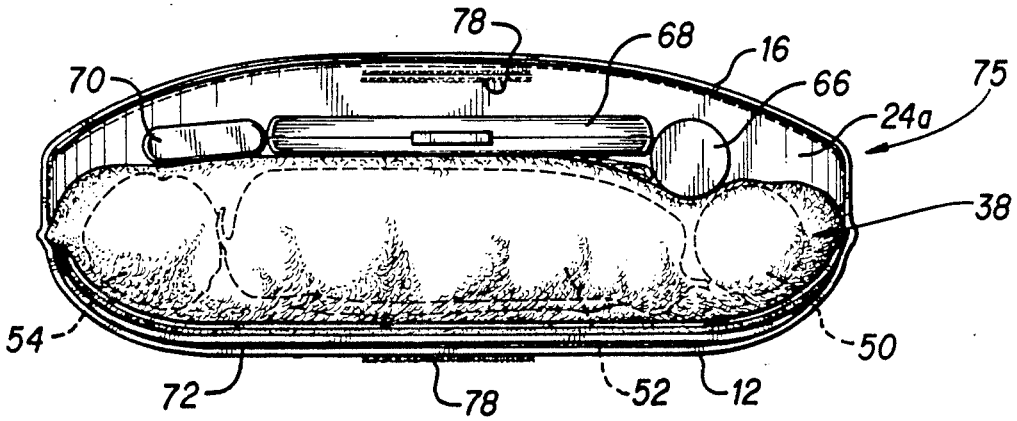
FIG. 5 is a top plan view of the assembly, illustrating further flap securing means.

With the described personal hygiene articles in place, the user of the assembly P is free to utilize the remaining, primary storage area 24*a* for the containment of more frequently used articles such as cosmetic items. FIGS. 1 and 5 depict typical cosmetic articles such as the tube of lipstick 66, compact 68 and rouge 70. Such latter articles are merely representative of any of several types of cosmetic devices which may be conveniently carried in the assembly P.

The secondary storage area 24*b*, intermediate the partition section 40 and front wall 12 and which defines a minimal front to rear dimension, provides a supplemental area having free access whenever the housing flap 16 is opened. This area offers a convenient location for the user to carry very thin, soft or hard items such as the credit card 72 as illustrated in FIGS. 1.2 and 5. Other items suitable for this area will include ID cards and folded currency.

Figure 4:
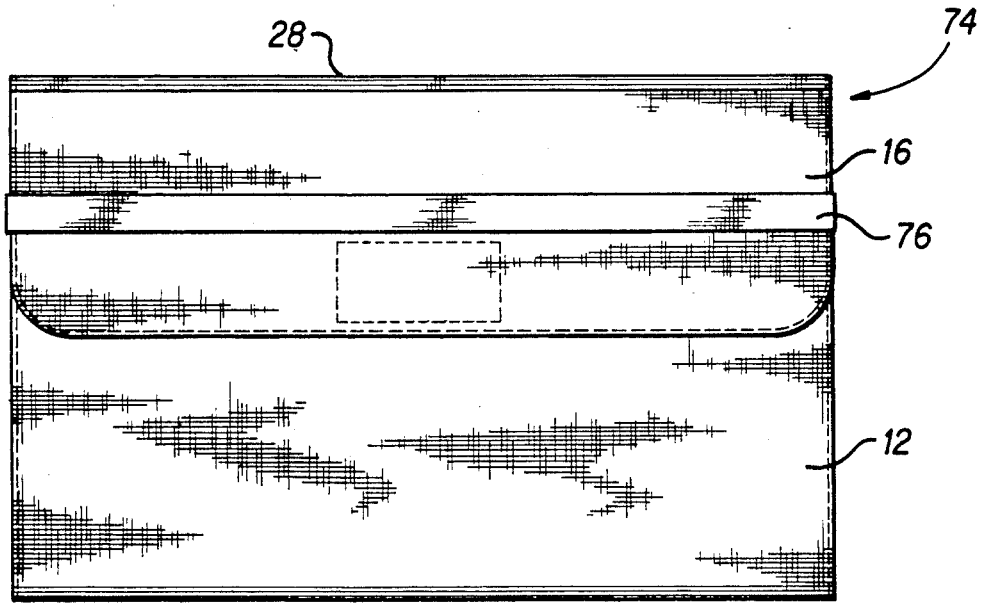
FIG. 4 is a front elevation illustrating alternative flap securing means.

The embodiments as shown in FIGS. 4 and 5 depict an assembly 74 and 75 providing alternative closure or securing means for the housing flap 16 and which may comprise either a transverse strap or loop 76 behind which the flap 16 is inserted or, VELCRO patches 78 on the opposed surfaces of the flap and housing front wall 12.

From the foregoing it will be seen that an improved kit or assembly for accommodating unexpected menses is provided and wherein personal hygiene articles may be carried in a hand held portemonnaie device that offers sequestered containment of these articles while allowing of normal access to other, regular use articles such as cosmetics, currency and the like. The described articles for support of feminine hygiene during menses are the primary items intended to be carried within the privacy area 24*c*. However, other articles associated with a woman's health and which one would wish to tactfully convey, may also be disposed therein. Such articles may include condoms, an IUD, diaphragm and the like so that, at all times, a woman would have available in complete confidence, those personal hygiene items she may require, while at the same time she would have at her fingertips the frequently utilized cosmetic items and personal identification, etc.

It is to be understood that the present invention is not limited solely to the embodiments described above, but encompasses any and all embodiments within the scope of the following claims.

I claim:

1. A portemonnaie assembly comprising;

a housing including a front panel joined to a rear panel along a bottom edge and defining a storage area therebetween having a top access, a flap extending from said rear panel and foldable to at least partially overlie said front panel and enclose said top access, an insert element disposed within said storage area and having an inner surface, said insert element including a partition section joined to a privacy section, means securing said partition section within said storage area and dividing said storage area into main and secondary storage areas, said inner surface of said partition section opposed to said housing rear panel, a plurality of personal hygiene articles within said main storage area contiguous with said partition section inner surface, and said privacy section foldable over said personal hygiene articles to partially enclose said top access and insertable into said main storage area intermediate said personal hygiene articles and said housing rear panel, whereby said personal hygiene articles are secluded from view while other type of articles may be inserted and removed from said main storage area intermediate said folded privacy section and housing rear panel.

2. A portemonnaie assembly according to claim 1 wherein, said personal hygiene articles include catamenial means and a pair of disposable panties each configured to define a thickness of substantially 1 to 1½ cm.

3. A portemonnaie assembly according to claim 1 wherein, said plurality of personal hygiene articles comprise feminine hygiene articles adapted to accommodate unexpected menses, said feminine hygiene articles defining substantially similar height and thickness dimensions and disposed in a laterally adjacent arrangement.

4. A portemonnaie assembly according to claim 1 wherein, said secondary storage area defines a front to rear dimension substantially less than that of said main storage area, whereby thin, planar type of articles may be disposed within said secondary storage area.

5. A portemonnaie assembly according to claim 1 wherein, said front and rear panels include juxtaposed lateral edges, means securing said juxtaposed lateral edges, and said insert element partition section having lateral edges joined to said front and rear panel lateral edges.

6. A portemonnaie assembly according to claim 1 including, a lining within said housing flap, front and rear panels, said insert element privacy section comprising supple material having a textured surface providing frictional engagement with said lining within said main storage area.

7. A portemonnaie assembly according to claim 2 wherein, said catamenial means includes a miniature tampon and a tri-folded feminine napkin.

8. A portemonnaie assembly according to claim 2 wherein, said pair of disposable panties comprise non-woven polymeric material folded and rolled into a cylindrical configuration.

9. A portemonnaie assembly according to claim 1 wherein, said personal hygiene articles include a packaged towelette.

10. A portemonnaie assembly according to claim 1 wherein, said personal hygiene articles include a flattened plastic bag allowing for the sanitary containment of a soiled feminine garment.

11. A portemonnaie assembly according to claim 1 wherein, said housing is of the hand held type.

12. A kit for accommodating unexpected menses comprising;

a portemonnaie including a housing having a front panel joined along a bottom edge to a rear panel and providing a storage area therebetween having a top access, a flap extending from said rear panel and foldable to cover said top access and overlie at least a part of said front panel, a supple insert element having a partition section fixedly attached within said storage area and forming a main storage area between said partition section and said rear panel, said insert element including a privacy section extending upwardly from said partition section and displaceable between first and second positions, said privacy section when in said first position disposed outside of said top access and when displaced to said second position disposed within said main storage area to define primary and privacy storage areas on opposite sides thereof with said privacy storage area located intermediate said privacy section and partition section, a plurality of personal hygiene articles disposed within said privacy storage area, and said personal hygiene articles including a catamenial device and a pair of disposable panties, whereby upon opening said flap to expose said top access, other articles may be inserted and removed from said primary storage area without exposing and accidentally removing said personal hygiene articles enshrouded within said privacy storage area by said privacy section when in said second position.

13. A portemonnaie assembly according to claim 1 wherein, said insert element privacy section includes tapered side edges joined to an end edge.

* * * * *